United States Patent [19]

Schober

[11] 4,146,185

[45] Mar. 27, 1979

[54] SHREDDER HAMMER

[75] Inventor: William R. Schober, Pompano Beach, Fla.

[73] Assignee: Waste Management, Inc., Oak Brook, Ill.

[21] Appl. No.: 854,169

[22] Filed: Nov. 23, 1977

[51] Int. Cl.[2] ..... B02C 13/28

[52] U.S. Cl. ..... 241/188 R; 241/194; 241/195

[58] Field of Search ..... 241/188 R, 193, 194, 241/195, 196, 197

[56] References Cited

U.S. PATENT DOCUMENTS

| | | | |
|---|---|---|---|
| 1,212,419 | 1/1917 | Sturtevant | 241/188 R X |
| 1,854,844 | 4/1932 | Kaemmerling | 241/195 X |
| 2,543,599 | 2/1951 | Rietz | 241/195 X |
| 3,400,527 | 9/1968 | Woodring | 241/194 X |

FOREIGN PATENT DOCUMENTS

| | | | |
|---|---|---|---|
| 397228 | 1/1974 | U.S.S.R. | 241/195 |

*Primary Examiner*—Howard N. Goldberg
*Attorney, Agent, or Firm*—Sughrue, Rothwell, Mion, Zinn and Macpeak

[57] ABSTRACT

A refuse shredder, which includes a rotor assembly and a housing, has removable shredder hammers which are adapted for replacement without disassembly of the rotor. The hammers have compound slots formed in the hammer bodies and have entry openings leading to the slots, whereby they are mounted on vertical hammer shafts of the rotor assembly.

5 Claims, 6 Drawing Figures

FIG 4
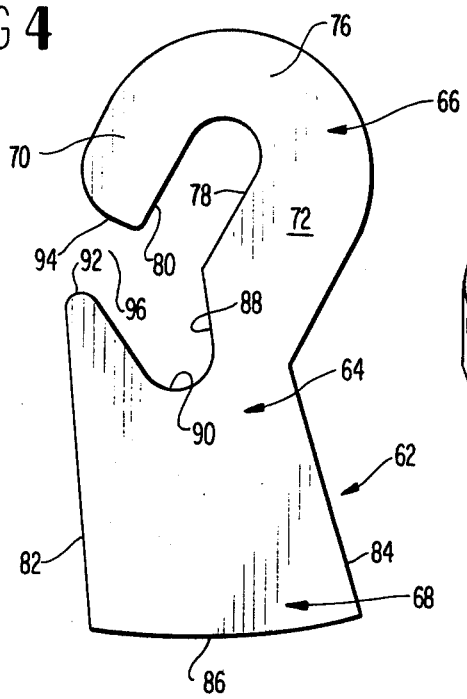
FIG 5
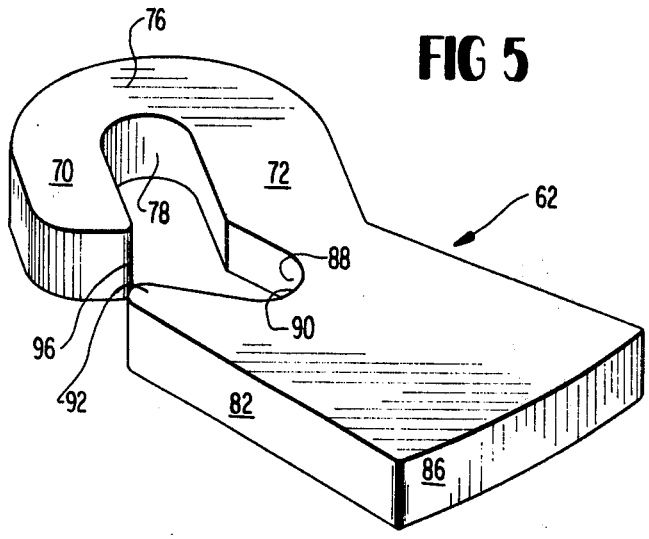
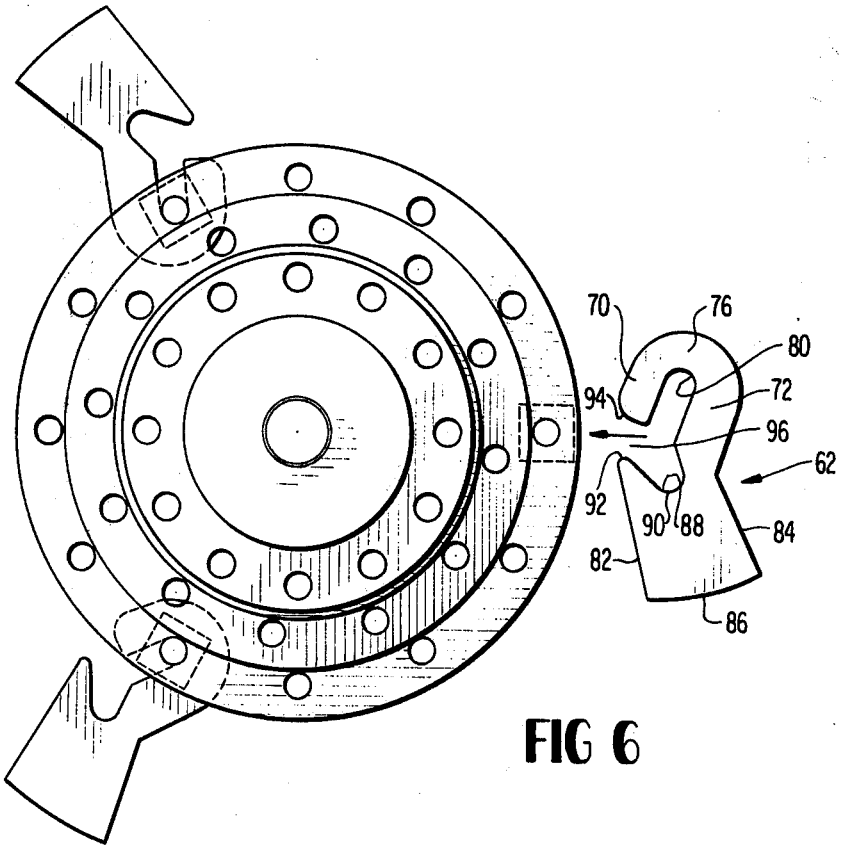
FIG 6

SHREDDER HAMMER

BACKGROUND OF THE INVENTION

1. Field of the Invention

This invention pertains to hammers employed in refuse shredders, more specifically to an improved hammer construction which is readily replaceable without the necessity for extensive disassembly of the machine, and one which provides improved operating characteristics.

2. Statement of the Prior Art

The apparatus improved by this invention is herein disclosed by way of showing the environment of use of the present invention in FIGS. 1 and 2 of the drawing and the description thereof. Additional representative patents in this field include the following:

| Patentee | Reg. No. | Date |
|---|---|---|
| H. G. Lykken et al | 2,497,088 | Feb. 14, 1950 |
| C. A. Rietz | 2,543,599 | Feb. 27, 1951 |
| T. E. Bridgewater | 3,088,685 | May 7, 1963 |
| T. E. Bridgewater | 3,093,329 | June 11, 1963 |
| T. E. Bridgewater | 3,110,449 | Nov. 12, 1963 |
| C. A. Adams | 3,150,833 | Sept. 29, 1964 |

SUMMARY OF THE INVENTION

Refuse shredders which employ a series of hammers mounted on vertical rotating shafts are finding increasing utilization in the refuse disposal industry. These shredders convert refuse into manageable and compact litter, which is more readily absorbed into landfills. Also, the shredding process reduces odors of the refuse, and renders it generally capable of more efficient handling. One such shredder which is particularly efficient is that sold by the Heil Company of Milwaukee, Wisconsin — Model 42D. In that shredder, and in others, a plurality of hammers are pivotally mounted on shafts. These shafts are on a rotor disposed within a housing, and the rotor is rotated during operation at a high rate of speed. The hammers are mounted in tiers of varying diameters, providing a short radius pre-break section, a throat section of increased size, and a lower grind section. As refuse material enters the pre-break section, larger items are impacted by the hammers and this impact reduces the size thereof. Also, in the pre-break section, unmillable articles are ballistically rejected. The refuse thus reduced or passing through the pre-break section then enters the throat section where additional grinding occurs, and unmanageable materials are further rejected. Finally, the residue gravitates into the lower grind section where final grinding occurs between the hammers and a series of stationary liner bars. The pulverized material is centrifically discharged through a bottom opening in the machine for transfer to a landfill.

From the foregoing, it will be understood that the hammers are subjected to substantial wear, particularly on the leading end surfaces thereof. Conventional maintaining of the hammers involves the provision of a hole therein, with vertical hammer mounting shafts extended through these holes. When wear occurs, it is necessary to withdraw the hammer shafts from the rotor housing, remove the hammers, and then replace the hammers or apply new leading surfaces by welding, or the like.

The conventional hammers are of rectangular configuration.

In the improvement hereof, a hammer body has a compound mounting slot comprising an entry opening and an angularly related recess communicating with the slot. The hammer comprises inner and outer body sections, also angularly related, the slot being arranged such that the hammer may be mounted or dismounted from the hammer shaft without the necessity for removal of the hammer shaft from the housing.

A further objective hereof is to provide a shredder hammer having improved impact characteristics, and one which is more resistant to wear.

Other and further objects and advantages of the invention will become apparent to those skilled in the art from a consideration of the following specification when read in conjunction with the annexed drawings.

BRIEF DESCRIPTION OF THE DRAWINGS

FIG. 4 is a top plan view of a shredder hammer constructed in accordance with this invention;

FIG. 5 is a perspective view thereof; and

FIG. 6 is a top view of the rotor assembly showing two of the hammers in place, and a third in position for application.

DESCRIPTION OF THE PREFERRED EMBODIMENT

Figure 1:
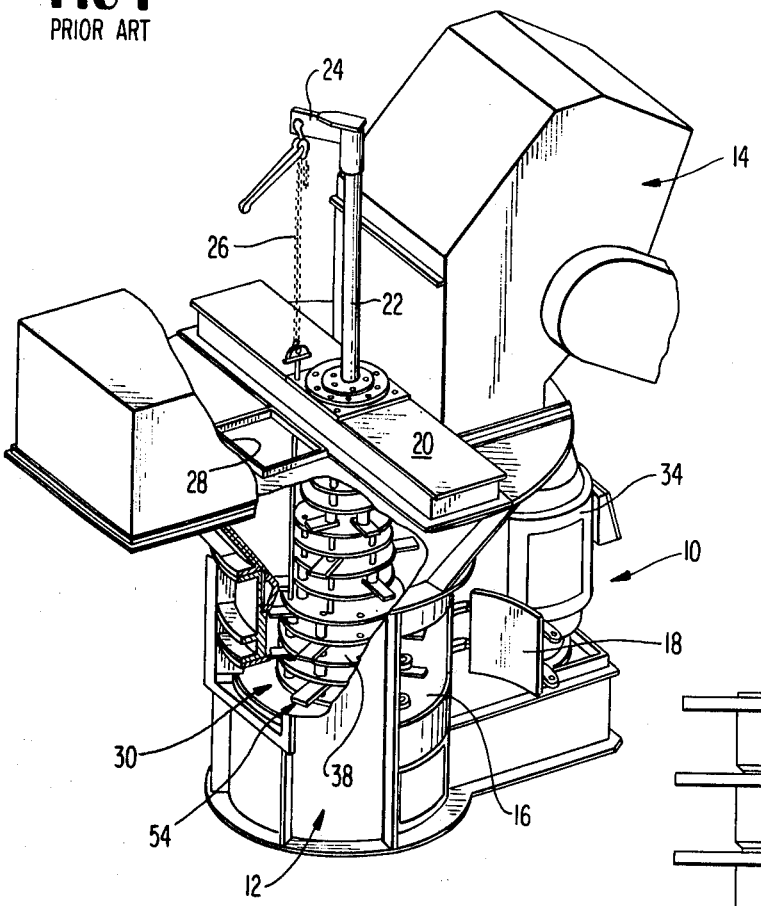
FIG 1 PRIOR ART
FIG. 1 is a perspective view, partially broken away for disclosure of details, showing a shredder of the type to which this invention is applicable.
Figure 3:
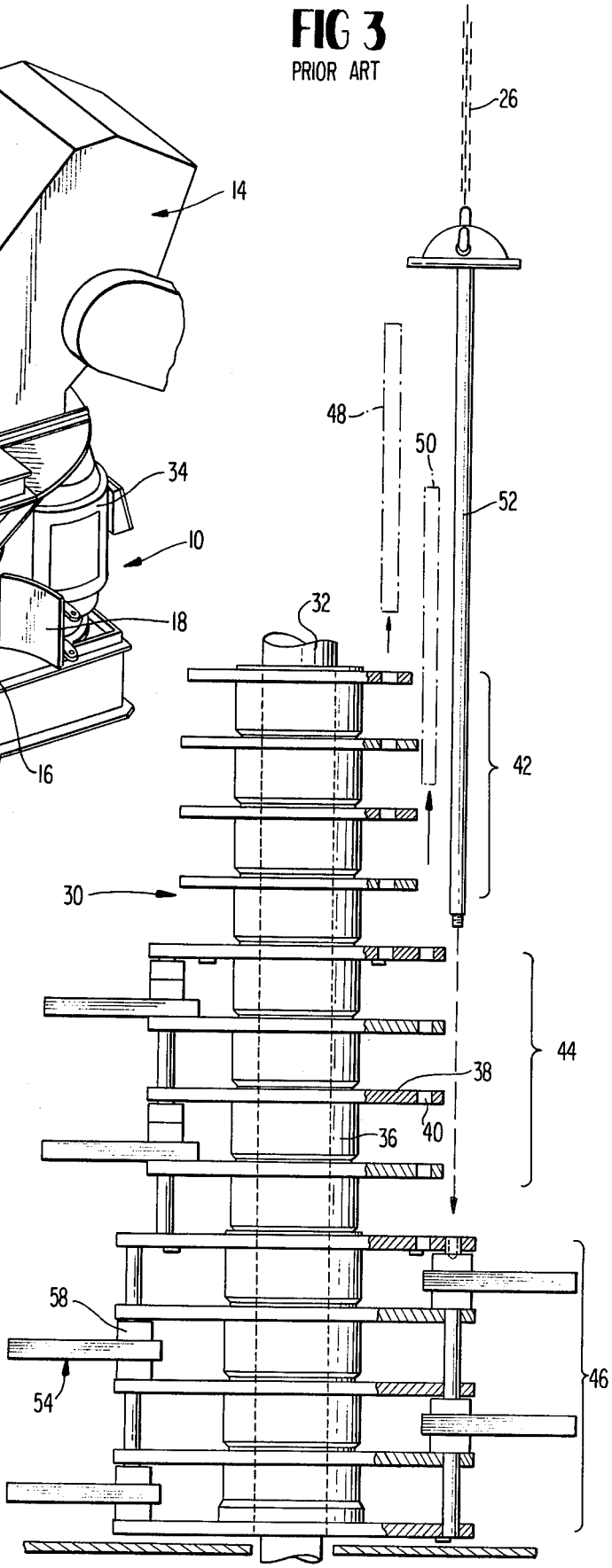
FIG 3 PRIOR ART
FIG. 3 is an enlarged elevational view, particularly in cross section, of the rotor assembly, prior art, illustrating removal of the hammer mounting shafts.
Figure 2:
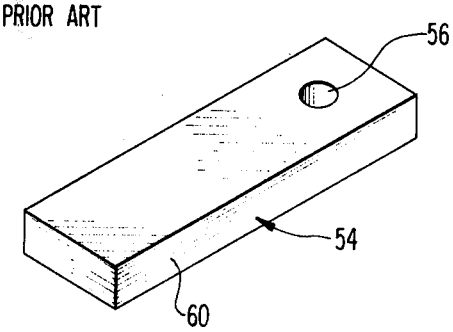
FIG 2 PRIOR ART
FIG. 2 shows, in enlarged perspective view, a prior art hammer which is replaced by the improved hammer hereof.

FIGS. 1 through 3 inclusive illustrate a typical environment of use of the shredder hammer of this invention. The overall shredder 10 includes a housing 12 which receives refuse from a conveying mechanism 14. Access to the housing for servicing of its components is through a side port 16 having a door 18. At the top of the housing 12 is a cross bar 20 with a central pillar 22. The pillar has an arm 24 with a chain hoist assembly 26. A reject window 28 is also provided for receiving the unmillable items ballistically rejected by the top tier of grinders, described below.

Mounted operatively within the housing is a rotor assembly 30. The rotor assembly comprises a vertical central drive shaft 32 (FIG. 3), connected to a drive motor 34 by a conventional drive linkage. Fixedly secured to the shaft are a series of annular spacers 36 each of which carries with it an outwardly extended plate 38. The plates have holes 40 therein.

As shown in FIG. 3, there are three tiers of plates: a pre-break section 42 at the top wherein the plates are of reduced diameter; a throat section 44 of increased size; and a grind section 46 which is still larger. The holes 40 of the respective plates 38 of each section are vertically aligned, and have mounting shafts 48, 50, 52 extended through the aligned holes.

The prior art hammer, designated 54 in the drawing, comprises a substantially rectangular black formed of heavy gauge hardened steel. Adjacent one end, the block has a bore 56 of a dimension to accommodate the shafts 48, 50, 52. As shown in the drawing, the hammers are positioned on the shafts between the plates, and maintained at selected elevation by blocks 58.

Rotation of the drive shaft 32 thus carries the plates 38, shafts and pivotally mounted hammers. It will be noted that the hammers 54 have a leading impact surface 60 (depending on the direction or rotation). The impact surface is subject to substantial wear, necessitating frequent servicing of the hammers. When this occurs, it is necessary to employ the chain hoist 26 to withdraw the shafts thereby freeing the hammers for removal. This removes the mechanism from operation for substantial periods of time, and necessitates maintaining a large inventory of replacement hammers.

The improvement hereof is illustrated in FIGS. 4 through 6. The shredder hammer hereof is there designated by general reference character 62. The hammer 62 comprises a solid metallic body 64 formed of hardened steel or equivalent material. The body, for purposes of description and orientation herein, includes an inner body section 66, and an outer body section 68.

The inner body section 66 is generally of U-form, and has a first arm portion 70 and a second arm 72. The arms are joined by a curvilinear bight portion 76. The arms and bight portion have interior edge walls 78, which define a slot 80. The slot 80 is of a width to accommodate the hammer shafts 48, 50 and 52, and is rounded at the bight to facilitate the pivotal contact of the hammer on the shaft.

The outer body section 68 of the hammer has a leading impact side wall 82, and a trailing side wall 84. It further includes an exterior, end edge wall 86. The wall 86 is curved outwardly in convex fashion.

The compound slot of the hammer further comprises a recess 88 formed in the outer body section. The recess has a rounded terminal end wall 90, and the leading impact wall terminates at a pointed end 92 which is spaced from the corresponding end 94 of the arm 70, thereby defining an entry opening 96 for the slot end recess. The entry slot is dimensioned to permit the hammer to be placed on the hammer shaft by passage of the shaft therethru and initially into the recess, and thereafter bringing the hammer forward to position the shaft in the slot 80 against the rounded bight thereof.

It will therefore be observed that each of the hammers may be readily mounted or dismounted from the hammer shaft without the necessity for withdrawal of the shafts from the shredder housing. The centrifrugal forces created during rotation of the rotor assembly prevent any inadvertent or accidental releases of the hammers, and the hammers thus function, after installation, much in the same fashion as the original prior art hammers.

It should be noted, however, that the leading impact wall of the improved hammer contacts the material at a slightly different angle than the angle of contact of the original rectangular hammers. This has been found to produce both an increased operational efficiency in terms of the grind produced, and also to result in increased life of the hammers before replacement is needed.

I claim:

1. In a refuse shredder having a rotor assembly with a vertical drive shaft, a series of spacers, extended plates on the spacers, and vertical hammer shafts, and having a housing with top entry for refuse to be pulverized, and bottom ejection of shredded refuse, a plurality of hammers each comprising:

an elongated hammer body having an inner body section and an outer body section;

the inner body section being generally U-shaped, and having first and second arm portions connected by a bight portion, and defining an interior mounting slot;

the bight portion having a rounded interior end edge wall;

the outer body section having a curvilinear exterior end edge wall, and having a leading impact wall and a trailing wall;

the outer body section having a recess formed therein in open communication with the slot of the inner body section;

the leading impact wall being spaced from the first arm portion of the inner body whereby an entry slot for the interior slot of the inner body and the recess is provided; and the entry slot being of a dimension sufficient to allow the passage of the vertical hammer shaft for engagement of the shaft in the interior slot to pivotally support the hammer on the shaft.

2. The invention of claim 1, wherein:

the outer body section and inner body section are angularly related to one another.

3. The invention of claim 2, wherein:

the angular relation is an obtuse angle whereby the leading impact wall trails the hammer shaft during rotation.

4. In a refuse shredder having a rotor assembly with a vertical drive shaft, a series of spacers on the shaft, plates on the shaft between the spacers and extending outwardly, and a plurality of vertical hammer shafts extending through the plates at spaced apart locations, the rotor assembly being rotatably mounted within a housing, a plurality of hammers, each hammer comprising:

an elongated hammer body having an inner body section and an outer body section;

said body sections being angularly related to one another and having opposite distal ends and side walls;

the hammer body having a mounting slot formed therein intermediate said distal ends, and said slot including an elongated interior slot formed in said inner body section, and a recess formed in said outer body section; and one of said side walls having an entry slot therein, whereby the hammers are removably, pivotally engaged on the vertical hammer shafts.

5. The invention of claim 4, wherein:

said interior slot and said recess each have an inside wall; and said inside walls are angularly related.

* * * * *